US005489374A

United States Patent [19]

Romine et al.

[11] Patent Number: 5,489,374

[45] Date of Patent: Feb. 6, 1996

[54] PROCESS FOR ISOLATING MESOPHASE PITCH

[75] Inventors: H. Ernest Romine; W. Mark Southard; Edward J. Nanni; Mark W. Carel, all of Ponca City, Okla.

[73] Assignee: Conoco Inc., Ponca City, Okla.

[21] Appl. No.: 334,647

[22] Filed: Nov. 7, 1994

[51] Int. Cl.[6] ..... C10G 27/00

[52] U.S. Cl. ..... 208/45; 208/39; 208/44; 208/22

[58] Field of Search ..... 208/22, 23, 39

[56] References Cited

U.S. PATENT DOCUMENTS 5,032,250 7/1991 Romine ..... 208/39

5,181,011 1/1993 Tsuchitani ..... 208/39

5,259,947 11/1993 Kalback ..... 208/22

*Primary Examiner*—Helane Myers

*Attorney, Agent, or Firm*—William D. Hall

[57] ABSTRACT

The present invention provides a process for obtaining a very clean mesophase pitch from isotropic pitch. This invention utilizes a solvent fractionation process which does not involve the process steps, yield loss and waste generation associated with fluxing and filtering the isotropic pitch. Additionally, this invention provides a liquid/liquid extraction process that avoids the solids handling and the high temperatures and pressures of supercritical fluid extraction. Finally, this invention controls the hardness of the mesophase product.

27 Claims, No Drawings

PROCESS FOR ISOLATING MESOPHASE PITCH

BACKGROUND OF THE INVENTION

It is well known that carbon fibers suitable for commercial applications may be produced from mesophase pitch. Carbon fibers derived from mesophase pitch have a high degree of molecular orientation and are light weight, strong, stiff, thermally and electrically conductive, as well as chemically and thermally inert. Mesophase-derived carbon fibers have been used as reinforcements in composites, have applications in the aerospace industry and are useful in quality sporting equipment. In contrast, carbon fibers produced from isotropic pitch exhibit little molecular orientation. As a result, they have relatively poor mechanical properties.

Mesophase pitch is not ordinarily available in existing hydrocarbon fractions, such as refining fractions, or in coal fractions, such as coal tars. However, methods are known for processing hydrocarbon fractions to obtain mesophase pitch. One well know method is to derive mesophase pitch from an isotropic pitch which contains mesogens. Isotropic pitches which contain mesogens are usually prepared by the treatment of aromatic feedstocks. Such treatment, which is well known in the art, may involve one or more heat soaking steps, with or without agitation, and with or without gas sparging or purging. Gas sparging may be carried out with an inert gas or with an oxidative gas, or with both types of operations. Numerous patents describe the preparation of isotropic pitch from aromatic containing feedstocks. Non-exhaustive but representative of such patents are: U.S. Pat. Nos. 4,283,269, heat soaking of fluxed pitch; Japanese Patent No. 65090/85, heating in the presence of an oxidizing gas; U.S. Pat. Nos. 4,464,248, catalytic heat soaking; 3,595,946 and 4,066,737, use of oxidative reactive material; and 4,474,617, use of oxidizing gas; and many others. Additionally, U.S. Pat. Nos. 4,184,942; 4,219,404; 4,363,715; 4,892,642 discuss the production and extraction of an isotropic pitch to obtain mesophase pitch.

In the past, mesophase pitch was commonly obtained by heat soaking a pitch feedstock to generate a mesogen containing isotropic pitch, followed by solvent fractionation to isolate the mesogens. In general, current solvent fractionation processes have the following steps:

(1) fluxing the isotropic pitch in a hot solvent, (2) separating flux insolubles by filtration, centrifugation, or other suitable means, (3) adding an anti-solvent to the clean flux filtrate (comix solvent) to precipitate the desired mesogens, (4) isolating the mesogens by washing and drying, and (5) fusing the mesogens to form mesophase pitch.

This solvent fractionation procedure is well known in the art and is set forth in some detail in numerous patents. For example, U.S. Pat. No. 4,208,267 first disclosed that an isotropic pitch can generate a solvent insoluble fraction which becomes mesophase within minutes on heating to its melting point ("sintering"). This patent discloses an extraction process which utilizes a comix type solvent and the mesogens are collected as an insoluble residue.

U.S. Pat. No. 4,277,324, incorporated herein by reference, describes the foregoing solvent fractionation process and sets forth the conditions, procedures and solvents/anti-solvents which can be employed in solvent fractionation. Additionally, the '324 patent describes the fluxing of an isotropic pitch followed by filtering the flux mixture. The patent then describes the addition of an anti-solvent to precipitate the desired insoluble mesogens from the flux filtrate. Finally, U.S. Pat. No. 5,032,250, incorporated herein by reference, deals with supercritical liquid/liquid extraction of an isotropic pitch for directly producing a mesophase pitch. The solvent fractionation described by '250 occurs at elevated temperatures and pressures such that both the solubles and insolubles are in the liquid state.

It is desirable to provide an alternative process for obtaining mesophase pitch from isotropic pitch which produces a very clean mesophase. Further, it is desirable to provide a solvent fractionation process which does not involve the process steps, yield loss and waste generation associated with fluxing and filtering the isotropic pitch. Still further, it is desirable to provide a liquid/liquid extraction process that avoids solids handling and does not require the high temperature and pressure of supercritical fluid extraction. Finally, it is also desirable to control mesophase product hardness in this process without the high temperatures and pressures of supercritical fluid extraction.

DEFINITIONS

For the purposes of this specification and claims, the following terms and definitions apply:

"Pitch" as used herein means substances having the properties of pitches produced as by-products in various industrial production processes such as natural asphalt, petroleum pitches and heavy oil obtained as a by-product in a naphtha cracking industry, and pitches obtained from coal.

"Petroleum pitch" means the residual carbonaceous material obtained from the catalytic and thermal cracking of petroleum distillates or residues.

"Petroleum coke" means the solid infusible residue resulting from high temperature thermal treatment of petroleum pitch.

"Isotropic pitch" means pitch comprising molecules which are not aligned in optically ordered liquid crystal.

"Anisotropic pitch" or "mesophase pitch" means pitch comprising molecules having aromatic structures which through interaction are associated together to form optically ordered liquid crystals, which are either liquid or solid depending on temperature.

"Mesogens" means molecules which when melted or fused form mesophase pitch. These molecules comprise a broad mixture of large aromatic molecules which arrange upon heating to form liquid crystals. An isotropic pitch can contain mesogens and these mesogens can be isolated by addition of an appropriate solvent.

"Fibers" means filaments of lengths suitable for formation into useful articles.

"Oriented Molecular Structure" means the alignment of mesophase domains in formed carbon-containing artifacts, which alignment corresponds to the axis of the artifact and provides structural properties to the artifact.

"Oxidation/Stabilization" is the process of making a pitch artifact infusible or unmeltable by reacting the artifact with oxygen or an oxidizing agent.

"Softening and Melting points" are determined by heating a sample at about 5° C./minute on a hot stage microscope under an inert atmosphere. The softening point for a dried pitch is the first rounding of angular features of the pitch particles. The melting point for a dried pitch is that temperature at which the first observable flow of the softened pitch is seen.

Clean isotropic feed pitch is a pitch which contains less than 500 ppm of mesophase insoluble components. Preferably the pitch will contain less the 250 ppm mesophase insoluble components.

Mesophase insoluble components encompasses those compounds which will not dissolve in the mesophase pitch. Typically, mesophase insoluble components will include inorganic ash, coke and other compounds.

Pitch oil is that portion of the pitch which boils at or below 525° C. at atmospheric pressure.

BRIEF DISCLOSURE OF THE INVENTION

The present invention provides an improved solvent fractionation process for generating mesophase pitch. The improved process reduces waste by-products by eliminating the steps of fluxing and filtering the heat soaked pitch. Additionally, the process of the present invention avoids the handling of solids by providing a sub-supercritical liquid/liquid extraction process. Further, the disclosed process provides a means for controlling the hardness of the resulting mesophase pitch product. Finally, the current invention provides a mesophase pitch which contains high molecular weight compounds commonly removed during fluxing and filtering of the heat soaked pitch when using known procedures.

According to this novel process, a clean feedstock is heat soaked to produce an isotropic pitch containing mesogens. Following heat soaking, the mesogens are isolated by liquid/liquid extraction of the heat soaked pitch in a single step at modest temperatures and pressures. The mesogen containing phase is recovered either as a liquid or a solid and stripped of any remaining solvent to yield a mesophase pitch.

The solvent fractionation process of the present invention provides a means for controlling the hardness of the resulting mesophase pitch. Specifically, the pitch oil content of the heat soaked isotropic pitch is adjusted either during or following the heat soaking step, thereby controlling the hardness of the resulting mesophase pitch product. Control of the pitch hardness provides a means for controlling the melting point of the resulting pitch and the stabilization rate of artifacts prepared from the pitch.

The present invention also provides the advantage of reducing waste by-products and increasing the yield of the mesophase product. Since fluxing of the heat soaked isotropic pitch is eliminated, the present invention does not produce any flux insolubles. As a result, the mesophase pitch of the present invention will contain all of the heavy organic flux insolubles originally present in the isotropic feed pitch, or generated during the heat soak step. Previous extraction process discarded these components with the flux insolubles; however, the present invention advantageously incorporates these components into the mesophase pitch.

DETAILED DESCRIPTION OF THE INVENTION

A. Solvent Fractionation

The present invention simplifies the solvent fractionation route to clean mesophase pitch. This new solvent fractionation process relies on the use of a clean isotropic pitch. In general, suitable isotropic pitches can be prepared from clean aromatic feedstocks. Preferred feedstocks include aromatic distillates of coal tar, ethylene tar, decant oil, petroleum gas oil and clean aromatic residues of coal tar, ethylene tar and decant oil. Decant oil distillate is a preferred feedstock. Although the distillate boiling range is not critical, distillates boiling from about 370° C. to 510° C. have been used successfully.

As used in this specification and the following claims, the term "Clean" means that suitable feedstocks should contain less than 50 ppm ash and be free of carbonaceous insoluble contaminants. Preferred distillate feedstocks are typically clear amber fluids. Black "distillates" are unsuitable as they generally contain entrained and/or suspended carbon contaminants. Use of the preferred feedstocks will yield a mesophase product containing less than 500 ppm mesophase insolubles. Preferably, the mesophase product will contain less than 250 ppm of mesophase insoluble contamination and less than 50 ppm of ash.

Ash contamination levels of the mesophase product may be determined by burning a weighed sample over a temperature range of 450° C. to 850° and comparing the weight of the remaining ash to the initial weight of the sample. Insoluble carbonaceous contamination of the mesophase product may be determined by observing the flow of the mesophase pitch or liquid extraction insolubles through a metal mesh or wire screen having 2 micron nominal and 7 micron absolute pore openings. When heated to about 50° C. above their melting points, the preferred products will be capable of passing through the 2 micron openings without appreciably blinding the openings.

Following determination of a suitable feedstock, the process of the present invention proceeds with a heat soak step. As is well known, heat soaking a feedstock generates an isotropic pitch which contains mesophase precursors known as mesogens. In the process of the present invention, heat soaking occurs at temperatures ranging from about 360° to about 550° C. Further, the present invention uses a low heat flux density to avoid the formation of coke. (Heat flux density is a measure of the flow or transfer of heat energy through a unit area of a given surface in a unit of time.) Preferably, the heat flux density will be less than 12 watts per square inch. Additionally, in order to prevent contamination of the pitch with inorganic compounds, precautions must be taken to use clean equipment and to avoid mechanical wear.

The present invention may be practiced in either a continuous processing mode or in a batch processing mode. When practiced in a continuous processing mode, heat soaking is stopped under conditions where the product pitch is entirely isotropic. However, substantially isotropic heat soaked pitch products which contain mesophase are suitable for the extraction steps of the present invention.

Following heat soaking, previous solvent fractionation methods have required the steps of fluxing and filtering the heat soaked pitch to remove contaminants. However, the present invention eliminates these process steps by the use of a clean particulate free heat soaked pitch. Thus, the process of the present invention proceeds directly from the heat soaking of the feed pitch to the solvent extraction of the mesogen- or mesophase-containing heat soaked pitch.

The solvent extraction process of the present invention can be performed as either a liquid/liquid extraction or a liquid/solid extraction. Liquid/liquid extractions are preferred because they equilibrate rapidly and adapt well to continuous processing methods. A further advantage of liquid/liquid processing is the ability to bypass the solids handling steps of digesting, filtering, washing, drying and remelting associated with liquid/solid extraction methods. Liquid/liquid extractions are performed at temperatures and pressures sufficient to maintain the heat soaked pitch, the solvent and the precipitated mesogens in the liquid state.

Typically suitable temperatures will be between about 100° and about 400° C. Preferably, the temperatures will be between about 180° and about 340 ° C. During the solvent extraction process, the pressure of the system must be sufficient to maintain the solvent in the liquid state. Typically the necessary pressure will be the autogenous pressure of the solvent at the process temperature. In general, the liquid/liquid extraction is performed at sub-supercritical solvent conditions, i.e. the temperatures and pressures of the extraction are lower than the solvent's critical temperature and pressure.

The extraction process is continued for a sufficient time to insure complete solubilization and extraction of the non-mesophase components. Typically, the extraction process will be completed in about 2 to about 60 minutes. After completion of the extraction, the system is separated into two phases. Subsequently, the solvent phase is removed and the insoluble mesophase forming phase is recovered as a liquid or cooled and recovered as a solid. Any residual solvent is removed from the mesophase product by flash evaporation or other appropriate processes to yield a solvent free mesophase pitch.

In liquid/solid extraction processes, the pitch and extraction solvent are combined at a temperature sufficient to precipitate the mesogens as a particulate solid. The pitch and solvent are mixed until all soluble pitch components are extracted by the solvent. Typically, this step will require 15 minutes to five hours.

B. Control of Pitch Hardness

The present invention also provides the ability to alter the hardness of the mesophase pitch product. The hardness of the extraction insolubles is directly related to the concentration of aromatic oil in the extraction system. Specifically, an increase in the pitch oil content of the heat soaked pitch will produce a harder, higher melting extracted mesophase pitch in a slightly reduced yield.

Adjustment of aromatic oil content may be performed by adjusting the pitch oil content of the heat soaked pitch. This adjustment may be accomplished by either topping of the feedstock to remove excess oils or by addition of pitch oil. Alternatively, according to the present invention, oil may be added during the solvent fractionation process. While pitch oil content may be from 0 to 70%, preferred feedstocks will contain from about 0 to about 40% oil by weight. In general, the minimum oil content of a feedstock is limited by the ability to remove the oil by distillation or sparging and the maximum oil content is limited by the desired yield of mesophase pitch.

Pitch oils suitable for addition to the isotropic feed pitch include both natural pitch oils and a broad range of aromatic oils derived from petroleum, coal or synthetic processes. In general, natural pitch oils are preferred. The preferred pitch oils will include a substantial fraction which has a boiling range of 450° C. to 525° C. Regardless of the oil used, the yield of the mesophase pitch may be affected as any alteration in pitch oils will also affect the extraction process due to the interaction of the oil with the solvent.

C. Improved Yield of Mesophase Pitch

As previously described, the present invention eliminates the steps of fluxing and filtering the heat soaked pitch prior to generating mesophase pitch. Typically, these process steps were used to eliminate non-mesogen insolubles. However, these processes also eliminate a portion of the relatively large, high molecular weight molecules present in the isotropic feed pitch. By eliminating these process steps, a mesophase pitch containing these previously removed compounds can be produced. As a result, the surprising ability to retain larger molecular weight compounds generates higher yields of the mesophase product. In addition to increasing the mesophase pitch yield by including flux insolubles in the product, the present invention avoids the generation of carbonaceous waste materials and eliminates process steps and associated equipment for fluxing and flux filtering.

EXAMPLES

The following examples are provided to illustrate the present invention. All parts and percentages are by weight unless otherwise specified. The applicants do not wish to be limited by the theory presented within the examples; rather, the true scope of the invention should be determined based on the attached claims.

Examples 1 and 2 demonstrate the solvent fractionation process of the present invention. These examples demonstrate the successful production of a mesophase pitch without the steps of fluxing and filtering the heat soaked pitch.

Example 1

A refinery decant oil was vacuum distilled to isolate a nominal 427° C. to 493° C. distillate containing less than 10 ppm mesophase insoluble ash. This distillate was heat soaked in an agitated pressure vessel for 3 hours 40 minutes at 441° C. and 120 psig. The heat soaked pitch was recovered with a 64.8% yield by weight. The pitch was completely isotropic and contained 11% tetrahydrofuran insolubles and less than 10 ppm mesophase insoluble ash.

Extraction was accomplished by combining 1 part pitch with 5 parts by weight solvent in a nitrogen purged pressure vessel. Solvent consisted of a 70:30 weight ratio blend of xylene and heptane. The vessel was sealed and solvent and pitch were heated to 200° C. and 76 psig autogenous pressure. The pitch solvent mixture was mixed at this temperature for 30 minutes, then allowed to settle for 15 minutes and then allowed to cool. A cake of solid pitch was recovered from the reactor bottom. The extraction residue was vacuum dried at 150° C. and then at 360° C. to give a mesophase pitch product in 22.0% yield by weight from the heat soaked pitch. The mesophase pitch tested 100% anisotropic and softened and melted at 330° C. and 344° C. respectively.

Example 2

The same distillate feedstock used in Example 1 was heat soaked in the same manner to give a 68.4% yield of heat soaked pitch by weight containing 11% tetrahydrofuran insolubles. This pitch was extracted with a 50:50 weight ratio of xylene:heptane using 5 parts solvent per one part of pitch. Example 1 conditions were used and autogenous pressure of 90 psig developed during extraction. Yield of 360° C. vacuum dried mesophase pitch was 23.0% by weight from the heat soaked pitch. The product was 100% anisotropic and softened and melted at 312° C. and 325° C. respectively. The mesophase insoluble ash content of the mesophase pitch product was determined to be less than 10 ppm.

Examples 3–8 demonstrate the ability of the present invention to control the hardness of a mesophase pitch product. As previously discussed, an increase in pitch hardness corresponds to an increase in melting point.

Examples 3–6

A heavy aromatic heat soaked pitch was prepared from a 454° C.+ residue of mid-continent refinery decant oil. The decant oil residue comprised 92% carbon, 6.5% hydrogen and contained 82% aromatic carbons by carbon 13 NMR testing. The decant oil residue was heat soaked 6.9 hours at 398° C. The resulting heavy aromatic heat soaked pitch contained 20% insolubles by weight in tetrahydrofuran (THF) using 1 gram of pitch in 20 ml of THF at 23° C. The pitch feeds for the extractions of Example 3 were made by adjusting the pitch oil content of the heat soaked decant oil. For Example 3, the heat soaked pitch was deoiled by vacuum distilling to an equivalent atmospheric cut point of 524° C. For purposes of these examples this is described as a 0% oil heat soaked pitch. For Example 4, the heat soaked pitch was vacuum topped to an equivalent atmospheric cut point of 357° C. to produce a 9% oil pitch. Untopped heat soaked pitch containing 19% oil was used in Example 5. The 28% oil pitch of Example 6 was made by combining 454° C. to 524° C. pitch oil with untopped pitch.

Each heat soaked pitch was extracted by combining crushed pitch and solvent in a sealed, evacuated autoclave and heating with stirring to 230° to 235° C. Each extraction mixture was prepared at a ratio of 1 gram of 0% oil pitch to 8 ml of solvent. In this instance the solvent comprised toluene and 524° C.– pitch oils (i.e. pitch oils having boiling points lower than 524° C.). Pressure of 160 to 185 psi developed at the extraction temperature. The mixture was stirred 1 hour and then allowed to settle 15 minutes before cooling. Insoluble pitch product was collected as a dense cake from the reactor bottom after removing the solvent phase and cooldown sludge.

Each insoluble pitch product was crushed, dried, and then fused under vacuum at 360° C. to remove substantially all solvent. The fused pitches were all fully anisotropic. The melting temperature of each fused pitch was determined by thermomechanical analysis (TMA) while heating at 10° C. per minute under a nitrogen flow. The melting point was taken as the second major derivative peak. The examples showed a substantial increase in fused pitch melting temperature as the amount of oil in the extraction medium is increased. As previously noted an increase in pitch melting temperature reflects an increase in pitch hardness.

TABLE 1

| | Examples 3 to 6 | | | |
|---|---|---|---|---|
| Example No. | 3 | 4 | 5 | 6 |
| Feed Pitch Percent Oil | 0 | 9 | 19 | 28 |
| Fused Pitch Product | 34.0 | 30.4 | 27.2 | 26.1 |
| Recovery, % of 0% Oil Feed | 324 | 333 | 338 | 45 |
| TMA Melting Temp, °C. | | | | |

Examples 7 and 8 demonstrate the ability to control pitch product melting temperature, yield and percent anisotropy by controlling the amount of pitch oil present during extraction.

Examples 7 and 8

A sample of Aerocarb 400 heavy aromatic pitch was obtained from Ashland Chemical Co. This pitch comprised 94% carbon and had a coking value of 72%. The pitch is less than 1% quinoline insoluble and 17.5% toluene insoluble. The pitch softened near 210° C. Aerocarb 400 does not contain significant pitch oil (material boiling below 524° C. atmospheric).

Aerocarb 400 pitch was extracted following addition of 454° C. to 524° C. aromatic pitch oil at conditions shown in Table 2. Oil derived from vacuum distilling heat soaked pitch oil as described in Example 3 was added in the toluene. The extractions were performed as described in the previous examples. Insolubles were recovered from the reactor bottom, crushed and fused to produce the fused products described in Table 2.

TABLE 2

| | Examples 7 and 8 | |
|---|---|---|
| Example No. | 7 | 8 |
| Feed Pitch Percent Oil | 0.0 | 20.0 |
| Extraction | | |
| Toluene (ml): Feed Pitch (g) | 8:1 | 8:1 |
| Temperature, °C. | 230 | 233 |
| Pressure, psi | 155 | 175 |
| Fused Pitch Product | | |
| Recovery, % of 0% Oil Feed | 39.9 | 30.3 |
| TMA Melting Temp, °C. | 310 | 323 |
| Anisotropy, Vol % | 52 | 77 |

Examples 9–10 and Table 3 demonstrate the ability of the present invention to selectively retain the higher molecular weight compounds in the resulting mesophase pitch product. This ability provides for higher yields of the resulting mesophase product.

Example 9

The same heat soaked pitch described in Example 5 was extracted by combining with mixed xylenes (42.9 wt % m-xylene, 24.6 wt % ethyl benzene, 21.6 wt % p-xylene and 10.8 wt % o-xylene) in a ratio of 8 ml solvent per gram of pitch. The extraction was performed in a sealed, evacuated autoclave. The mixture was heated while stirring to 320° C. during 1 hour and 20 minutes. Pressure reached 100 psig. The mix was stirred 1 hour and then allowed to settle for 15 minutes at 231° C. After cooling, the autoclave was opened and a dense cake of insoluble pitch was recovered from the reactor bottom. The pitch product was crushed and heated under vacuum to 360° C. to remove 21.5% volatiles. The solvent-free mesogens were obtained in 25.3% yield and melted at 386° C.

Example 10

As a comparision, the heat soaked pitch described in Example 9 was combined with an equal weight of toluene and heated to 110° C. to form a flux mixture. This mixture was filtered with a small amount of Celite filter aid to remove flux insolubles. The flux insolubles amounted to 9.4% of the pitch. The flux insolubles are unmeltable and represent relatively high molecular weight pitch components. Clean flux filtered pitch was stripped of toluene and stored under nitrogen.

Extraction was performed by adding crushed flux filtered pitch to a clean autoclave. The autoclave was sealed and evacuated and 1.1 parts by weight of xylene was added. The filtered flux was reformed by stirring while heating to 90° C. during ½ hour. The reformed flux mixture was diluted with additional xylene so that the final mixture contained 8 ml of solvent per gram of original non-flux-filtered heat soaked pitch. Extraction occurred at 231° C. for 30 minutes at 100 psig. The mixture was allowed to settle for 15 minutes at 231° C. and then cooled. A solid cake of insoluble pitch was recovered from the reactor bottom. Heating to 360° C. under vacuum removed volatiles. The solvent-free mesogens were obtained in 18.5% yield and partially melt at 363° C.

Example 9 and comparative Example 10 confirm the yield increase benefit of increasing the large molecular weight content of solvent extracted mesophase. This benefit occurs with only a small increase in solvent-free mesogen melting temperature.

TABLE 4

| | Examples 9 and 10 | |
|---|---|---|
| Example No. | 9 | 10 |
| Melting Point of Mesophase Pitch Product | 386° C. | 363° C. |
| Yield of Dry Mesophase Pitch | 25.28% | 18.53% |

It should be obvious to one skilled in the art that the liquid/liquid extraction of clean heat soaked pitch to form clean mesophase pitch in Examples 1 and 2, the control of mesophase pitch hardness by adjusting oil in Examples 3 to 8 and the yield enhancement of including organic flux insolubles in the mesophase pitch shown in Example 9 can be combined to provide an especially advantageous process for making mesophase pitch.

Further, embodiments of the present invention will be apparent to those skilled in the art from a consideration of this specification or practice of the invention disclosed herein. It is intended that the specification and examples be considered as only exemplary, with the true scope and spirit of the invention being indicated by the following claims.

We claim:

1. A solvent fractionation process for generating a mesophase pitch from a feed pitch comprising:

heat soaking a feedstock having less than 500 ppm mesophase insoluble impurities to produce an isotropic heat soaked pitch containing mesogens;

extracting said heat soaked pitch with a solvent at a temperature and pressure sufficient to maintain said solvent and said mesogens in the liquid state, said temperature and pressure being less than the supercritical temperature and pressure of said solvent to isolate said mesogens;

recovering said mesogens;

stripping solvent from said mesogens to yield a mesophase pitch.

2. The process of claim 1, wherein said feedstock is selected from the group consisting of aromatic distillates of coal tar, aromatic distillates of ethylene tar, aromatic distillates of decant oil, aromatic distillates of thermal tar, aromatic residues of coal tar, aromatic residues of ethylene tar and aromatic residues of decant oil.

3. The process of claim 1, wherein said feedstock has less than 50 ppm ash.

4. The process of claim 1, wherein said extraction step is a liquid/liquid extraction and includes contacting said heat soaked pitch with solvent at sufficient temperature and pressure to cause both the soluble phase and the insoluble mesogen-containing phase to be liquids such that during said recovery step, the solubles and insolubles are isolated continuously as liquids.

5. The process of claim 1, wherein the extraction mixture is cooled and the solubles are recovered as a liquid and the mesogen-containing insolubles are isolated as a solid pitch.

6. The process of claim 1, including the step of controlling the hardness of the mesophase pitch by adjusting the pitch oil content during or subsequent to said heat soaking step.

7. The process of claim 6, wherein said pitch oil content comprises between about 0 to about 70% of said heat soaked pitch by weight.

8. The process of claim 1, wherein substantially all of the mesogens originally in the feed stock and including any mesogens which were generated during the heat soaking step are present within the mesophase pitch and, said mesophase pitch contains less than 500 ppm insolubles and said mesophase pitch flows through a 2 micron screen when molten.

9. The process of claim 1, wherein said mesogens when in the molten state pass through a two micron nominal, seven micron absolute filter and contain less than 50 ppm ash.

10. The process of claim 1, wherein said sub-supercritical liquid/liquid extraction is performed at temperatures and pressures lower than said solvent's critical temperature and pressure.

11. A solvent fractionation process for generating a mesophase pitch from a feedstock comprising:

heat soaking a feedstock having less than 50 ppm ash to produce an isotropic heat soaked pitch containing mesogens;

extracting said heat soaked pitch with a solvent to isolate said mesogens including substantially all heavy flux insolubles originally present within said feedstock or which were generated during said heat soaking step;

recovering said mesogens;

stripping solvent from said mesogens to yield a mesophase pitch.

12. The process of claim 11, wherein said feedstock is selected from the group consisting of aromatic distillates of coal tar, aromatic distillates of ethylene tar, aromatic distillates of decant oil, aromatic distillates of thermal tar, aromatic residues of coal tar, aromatic residues of ethylene tar and aromatic residues of decant oil.

13. The process of claim 11, wherein said extraction step is a liquid/liquid extraction performed at sufficient temperature and pressure to maintain said solvent and said mesogens in the liquid state.

14. The process of claim 11, wherein said extraction step is a liquid/liquid extraction and includes contacting said heat soaked pitch with solvent at sufficient temperature and pressure to cause both the soluble phase and the insoluble mesogen-containing phase to be liquids such that during said recovery step, the solubles and insolubles are isolated continuously as liquids.

15. The process of claim 11, wherein the extraction mixture is cooled and the solubles are recovered as a liquid and the mesogen-containing insolubles are isolated as a solid pitch.

16. The process of claim 11, including the step of controlling the hardness of the mesophase pitch by adjusting the pitch oil content during or subsequent to said heat soaking step.

17. The process of claim 16, wherein said pitch oil content comprises between about 0 to about 70% of said heat soaked pitch by weight.

18. The process of claim 11, wherein said mesogens when in the molten state pass through a two micron nominal, seven micron absolute filter and contain less than 50 ppm ash.

19. A solvent fractionation process for generating a mesophase pitch from a feedstock comprising:

heat soaking a feedstock to produce an isotropic heat soaked pitch containing mesogens;

controlling the hardness of said mesogens by adjusting the pitch oil content of said heat soaked pitch;

extracting said heat soaked pitch with a solvent to isolate said mesogens;

recovering said mesogens;

stripping solvent from said mesogens to yield a mesophase pitch.

20. The process of claim 19, wherein said feedstock is selected from the group consisting of aromatic distillates of coal tar, aromatic distillates of ethylene tar, aromatic distillates of decant oil, aromatic distillates of thermal tar, aromatic residues of coal tar, aromatic residues of ethylene tar and aromatic residues of decant oil.

21. The process of claim 19, wherein said feedstock has less than 50 ppm ash.

22. The process of claim 19, wherein said extraction step includes maintaining sufficient temperature and pressure such that said solvent and said mesogens are in the liquid state.

23. The process of claim 19, wherein said extraction step includes contacting said heat soaked pitch with solvent at sufficient temperature and pressure to cause both the soluble phase and the insoluble mesogen-containing phase to be liquids such that during said recovery step, the solubles and insolubles are isolated continuously as liquids.

24. The process of claim 19, wherein the extraction mixture cooled and the solubles are recovered as a liquid and the mesogen-containing insolubles are isolated as a solid pitch.

25. The process of claim 19, wherein substantially all of the mesogens originally in the feedstock and including any mesogens which were generated during said heat soaking step are present within the mesophase pitch and, said mesophase pitch contains less than 500 ppm insolubles and said mesophase pitch flows through a 2 micron screen when molten.

26. The process of claim 19, wherein said mesogens when in the molten state pass through a two micron nominal, seven micron absolute filter and contain less than 50 ppm ash.

27. The process of claim 19, wherein said pitch oil content comprises between about 0 to about 70% of said feedstock by weight.

* * * * *

UNITED STATES PATENT AND TRADEMARK OFFICE

CERTIFICATE OF CORRECTION

PATENT NO.: 5,489,374

DATED: February 6, 1996

INVENTOR(S): Mark W. Carel, H. Ernest Romine, W. Mark Southard, and Edward J. Nanni It is certified that error appears in the above-identified patent and that said Letters Patent is hereby corrected as shown below:

Column 7, line 53, Table 1, under Example No. 6, "45" should be --345--.

Column 7, line 53, the temperatures should have been on line 54.

Signed and Sealed this

Twenty-third Day of April, 1996

Attest:

Bruce Lehman

BRUCE LEHMAN

Attesting Officer

Commissioner of Patents and Trademarks